United States Patent [19]

Wang

[11] Patent Number: 4,779,534

[45] Date of Patent: Oct. 25, 1988

[54] ROCKET FIRECRACKERS GIVING OUT SMOKE BEFORE FLYING UP

[76] Inventor: Chiey-Yi Wang, No. 179-1, LIU Tzu Liu suei Shang Hsiang, Chiayi, Taiwan

[21] Appl. No.: 118,984

[22] Filed: Nov. 10, 1987

[51] Int. Cl.[4] ..... F42B 13/44

[52] U.S. Cl. ..... 102/334

[58] Field of Search ..... 102/334

[56] References Cited

U.S. PATENT DOCUMENTS 4,621,580 11/1986 Castera et al. ..... 102/334

4,636,364 1/1987 Geyer et al. ..... 102/334 X 4,667,601 5/1987 Diamond et al. ..... 102/334 X

*Primary Examiner*—Peter A. Nelson

*Attorney, Agent, or Firm*—Holman & Stern

[57] ABSTRACT

This invention concerns a rocket firecracker giving out smoke before flying up. It comprises a shooting-up tube, a smoke tube, a fuse, a flying wing, and a launch pad. The shooting-up tube not only contains shooting-up chemicals but also the smoke tube filled with smoking chemicals set inside its lower part and when the smoking chemicals have been burned up giving out a lot of smoke and the firecracker has flown up in the air for a short while with the shooting-up chemicals being burned, the smoke tube with its chemicals burned up can be blown off the shooting-up tube and fall down, but the firecracker still continues to fly up till all the shooting-up chemicals are used up.

2 Claims, 3 Drawing Sheets

ROCKET FIRECRACKERS GIVING OUT SMOKE BEFORE FLYING UP

BACKGROUND OF THE INVENTION

There are many kinds of firecrackers, but if it can be played with an effect like a space shuttle or a space ship does, maybe children or boys would be much interested in it. So the inventor has worked out this new kind of improved firecracker.

SUMMARY OF THE INVENTION

This invention, rocket firecrackers giving out smoke before flying up, is made mimicking the shooting-up process of a space shuttle or a space ship driven by rockets. So this firecracker can produce a large amount of smoke at first when set on fire before it begins to fly up high into the air. A short while after the firecracker has flown into the air, the smoke-producing chemical tube would fall down. Then it can increase the interest of playing firecrackers for young children or boys.

This rocket firecracker giving out smoke before flying up includes a shooting-up tube, a smoke tube, a flying wing, a launch pad and a fuse. The smoke tube is inserted in the lower part of the long shooting-up tube and the lower part of the shooting-up tube is set in the central hole of the flying wing and finally the flying wing is mounted on the launch pad to make up a straight standing-up firecracker like a space shuttle on a launch pad.

After the fuse connected with and extending outside the smoke tube is set on fire, the smoking chemicals in the smoke tube is to gradually burn up giving out a large quantity of smoke, and the shooting-up chemicals in the shooting-up tube is then to be burned and to fly up leaving the launch pad. After the firecracker has flown a while, the shooting-out force of the burhing of the shooting-up chemicals can push the smoke tube to be separated with the shooting-up tube falling down to the ground, but the remaining parts of the firecracker continues to fly up higher and farther owing to its lighter weight caused by the falling down of the smoke tube from the fircracker.

BRIEF DESCRIPTION OF THE DRAWINGS

FIG. 5 is a view of this firecracker with its smoke tube falling down after it has flown up a little while.

DETAILED DESCRIPTION OF THE INVENTION

Figure 1:
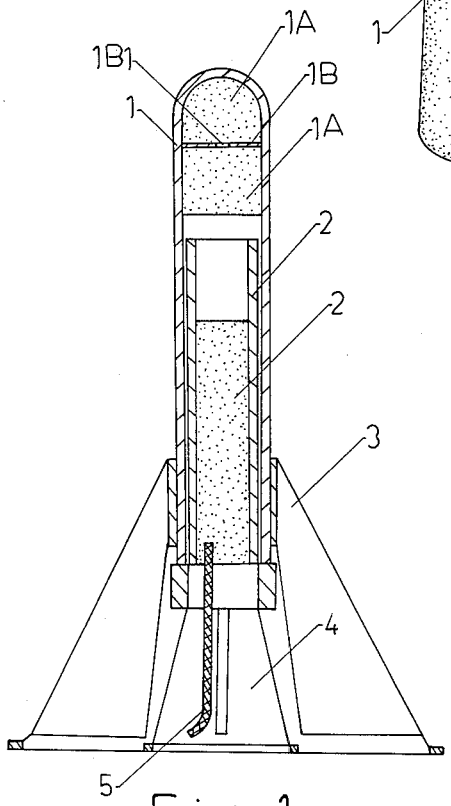
FIG. 1 is a cross-sectional view of the rocket firecracker giving out smoke before flying up in this invention.
Figure 2:
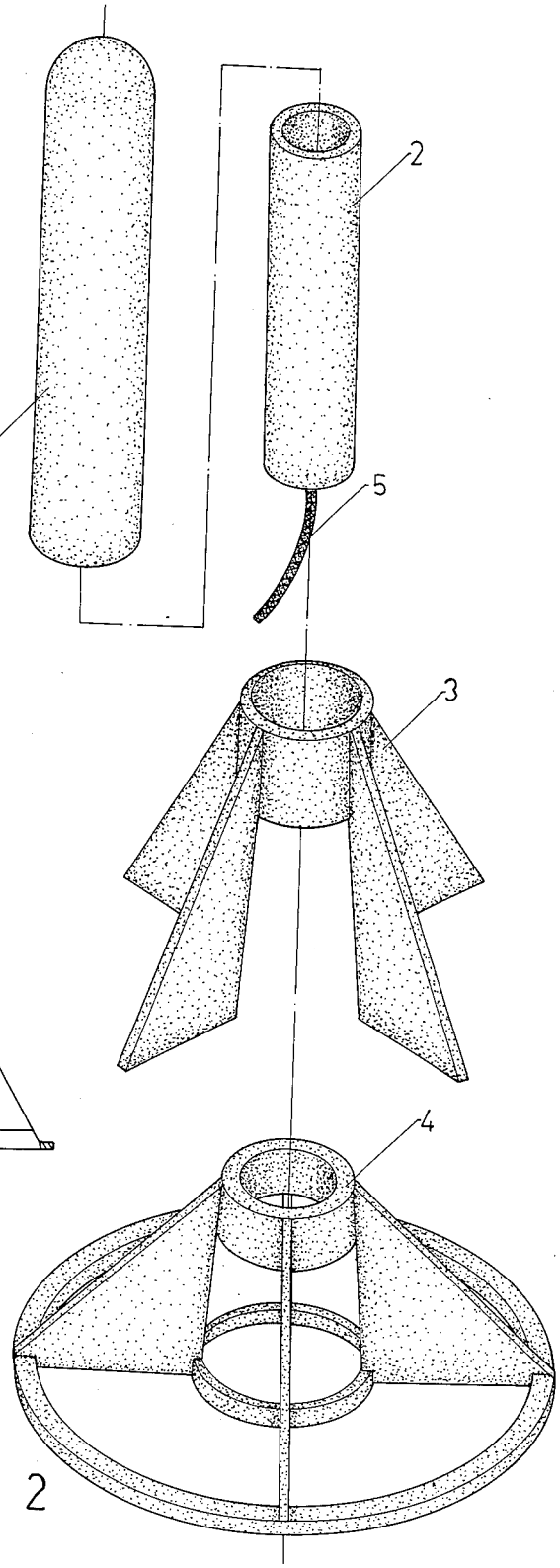
FIG. 2 is an explosive perspective of the rocket firecracker giving out smoke before flying up in this invention.
Figure 3:
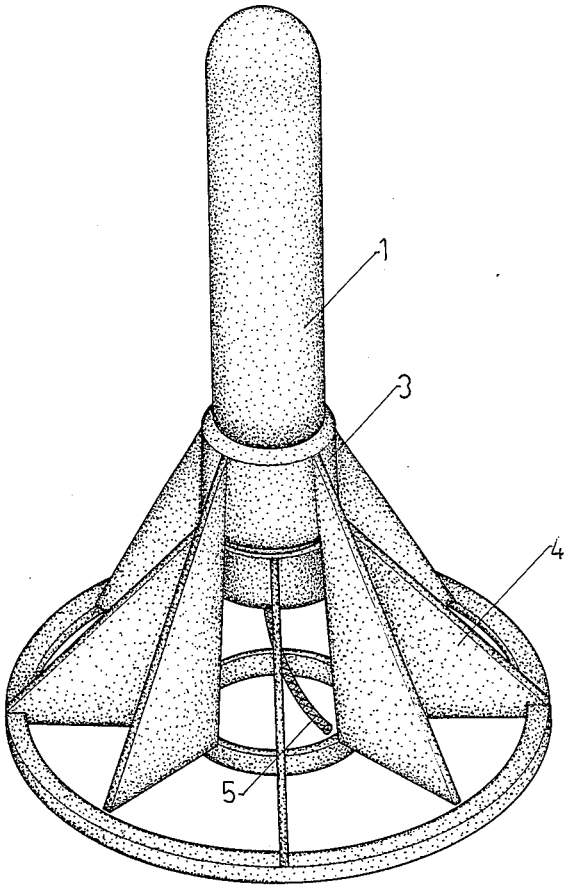
FIG. 3 is an outward view of the rocket firecracker giving out smoke before flying up in this invention.

This invention, a rocket firecracker giving out smoke befoe flying up, comprises shooting-up tube 1, smoke tube 2, flying wing 3, launch pad 4 and fuse 5 as FIG. 1,2 show, Its outward form is not limited to the example shown in the figures. Smoke tube 2 is filled with smoking chemicals 2A and inserted in the lower part of shooting-up tube 1, which is filled with shooting-up chemicals 1*a* at its upper part. Shooting-up chemicals

1A is separated into two parts with horizontal separating wall 1B bored with burning hole 1B1 set between the two parts. Shooting-up tube 1 and flyingwing 3 are combined together with the lower end of shooting-up tube 1 set in the cetral round hole of flying wing 3, and then flying wing 3 is mounted on launch pad 4. All these parts being combined together, this firecracker looks straight up on the ground.

Figure 4:
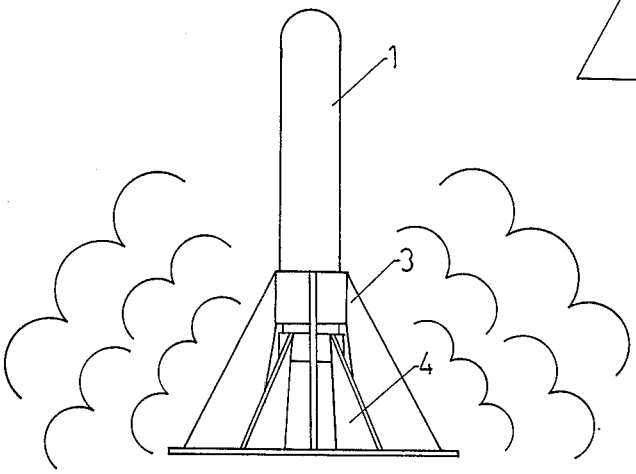
FIG. 4 is a view of this firecracker in the smoking condition before flying up.
Figure 5:
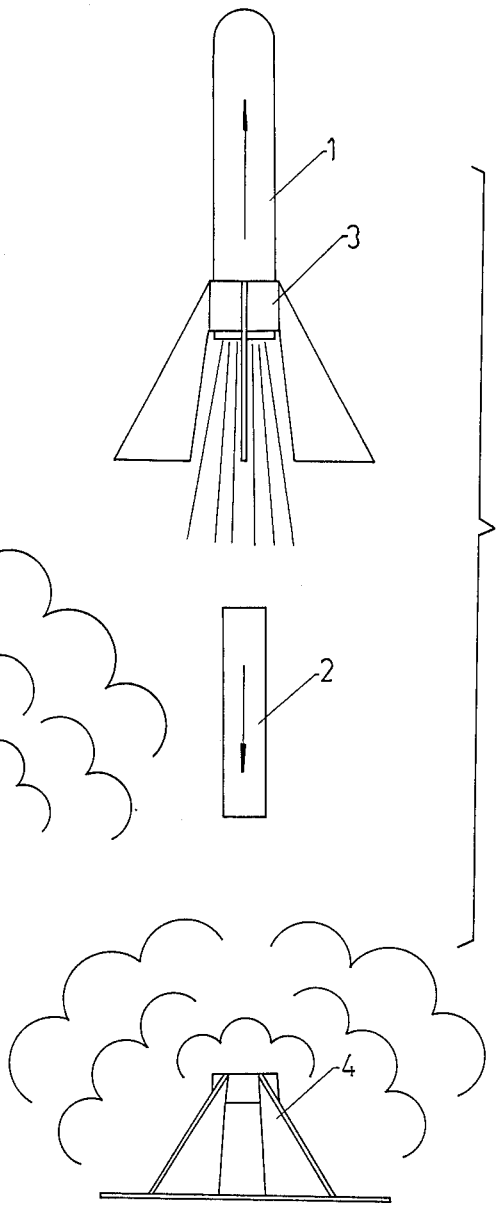

Igniting fuse 5 connected with smoke tube 2A can make smoke sube 2 giving out quite a large quantity of smoke as FIG. 4 shows. When smoking chemicals 2A is about to finish, the lower part of shooting-up chemicals 1A under separating wall 1B is to be ignited by the flame of smoking chemicals 2A, and the firecracker is to begin to fly up by the shooting-up force of burning shoothing-up chemicals 1A. Smoke tube 2 can be pushed out of the shoothing-up tube 1 by the shooting-out force of burning shooting-up chemicals 1A a little while after the firecracker has flown up as FIG. 5 show. Then the remaining parts of the firecracker continue to fly up higher and farther as its weight has become lighter with smoke tube 2 fell down, and while the upper part of shooting-up chemicals 1*a* on separating wall 1B is burning, burning hole 1B1 can give out an explosive sound to augment the pleasure of the player and the audience.

As for the tubes used for filling the chemicals, the shooting-up tube 1 is generally made of polypropylene, polyethylene or paperand so is also smoke tube 2. Nevertheless, it is better to use such paper as burns rather slowly so that smoke tube may be blown off shooting-up tube smoothly after a short while. Besides, the tightness of smoke tube 2 inserted in shooting-up tube 1 must not be too intense, otherwise smoke tube 2 cannot be blown off shooting-up tube 1 by the jet force genereated by the burning of the shooting-up chemicals while ascending into the air.

The formula of the chemicalas 1A in shooting-up tube 1 comprises potassium perclorate KCLO4 as an oxidizer, any combination of sodium benzoate Nac7-H5O2, sodium salicylate C6H4(OH)COONa, potatassium salicylate C6H4(OH)COOK, purogallic acid C6H3(OH)3 and salicylic acid C6H4(OH)COOH as a reducer and a little amount of metallic titanium; while the formula of the smoking chemicals 2*a* in the smoke tube 2 comprises salt of chloric acid such as potassium chlorate or salt of nitronic acid such as potassium nitrate as an oxidizer, and the mixture of carbon, sulphur, sodium bicarbonate and pigments with high burning point such as prussian blue as a reducer.

This invention, an improved rocket firecracker produces a large quantty of colored smoke at the first process of ignition then begins to shoot up like a rocket possibly with an whistle and the moke tube already burned up is to fall down after a little while of flying in the air blown off the firecracker, which then continues to fly higher and higher until it explodes or it nay not necessarily explode. So this firecacker can be played with much interest because of its new structrue and new launching process;

What is claimed is:

1. A firecracker for simulating the launching and flight of a multi-stage rocket, the firecracker comprising an outer shoot-up tube having and upper closed nose end and an open lower end, ignitable propulsion chemical means in the nose end of the shoot-up tube, a smoke tube for receipt in the shoot-up tube below said chemical means, the smoke tube containing smoke-producing chemical means, a fuse for igniting the smoke-producing chemical means extending from one end of the smoke tube, a finned wing structure for the lower end of the shoot-up tube, and a launch pad member for supporting the shoot-up tube and wing structure in upright launch position with the smoke tube inserted in the shoot-up tube and the fuse extending there-below, the smoke-producing chemical means when ignited by the fuse being effective for ejecting smoke from the lower end of the shoot-up tube and subsequently igniting the propulsion chemical means, they propulsion chemical means when ignited being effective for developing pressure within tubes to launch the tubes from the launch pad means into upward flight and subsequently separate the tubes whereby the smoke tube may fall to earth with continued upward flight of the shoot-up tube.

2. A firecracker as defined in claim 1 wherein the shoot-up tube includes a perforated baffle separating the propulsion chemical means into upper and lower portions.

* * * * *